United States Patent [19]

Medovar et al.

[11] 4,185,683

[45] Jan. 29, 1980

[54] ELECTROSLAG REMELTING MOULD

[76] Inventors: Boris I. Medovar, ulitsa Anri Barbjusa, 22/26, kv. 109; Viktor L. Artamonov, ulitsa Shumskogo, 8, kv. 90; Alexei G. Bogachenko, ulitsa Miljutenko, 15/2, kv. 141; Jury P. Shtanko, ulitsa Dobrokhotova, 26, kv. 53; Oleg P. Bondarenko, ulitsa Kreschatik, 15, kv. 34, all of Kiev; Konstantin S. Eltsov, ulitsa Tbilisskaya 15, kv. 7, Zaporozhie; Nikolai V. Stetsenko, ulitsa Patrioticheskaya 32, kv. 25, Zaporozhie; Sergei S. Popov, ulitsa 40 let Sovetskoi Ukrainy, 51, kv. 49, Zaporozhie; Gary P. Kaganovsky, ulitsa Bocharova 8, kv. 48, Zaporozhie; Albert N. Korotkov, ulitsa Lenina, 228, kv. 2, Zaporozhie, all of U.S.S.R.

[21] Appl. No.: 870,516

[22] Filed: Jan. 18, 1978

[51] Int. Cl.[2] ..... B22D 21/02; B22D 27/02

[52] U.S. Cl. ..... 164/252; 164/259

[58] Field of Search ..... 164/50, 52, 250, 252, 164/66, 67, 68, 72, 73, 149, 259, 415; 13/9 ES; 75/10 R, 10 C, 45, 59, 60, 93 E; 266/216, 217, 224, 218; 239/552, 553, 553.3

[56] References Cited

U.S. PATENT DOCUMENTS

| | | | |
|---|---|---|---|
| 733,236 | 7/1903 | Machlet, Jr. | 239/552 |
| 2,468,824 | 5/1949 | Hughey | 239/552 |
| 3,689,048 | 9/1972 | Foulard et al. | 164/66 |
| 3,767,125 | 10/1973 | Grehres et al. | 239/552 |
| 3,776,294 | 12/1973 | Paton et al. | 164/52 |
| 3,891,429 | 6/1975 | Cox et al. | 75/59 |
| 3,924,672 | 9/1975 | Paton et al. | 164/252 |
| 3,932,172 | 1/1976 | Knuppel et al. | 75/59 |
| 3,989,091 | 11/1976 | Medovar et al. | 164/252 |
| 4,042,007 | 8/1977 | Zavaras et al. | 164/82 |
| 4,105,725 | 8/1978 | Ross | 164/16 |

FOREIGN PATENT DOCUMENTS

| | | | |
|---|---|---|---|
| 764606 | 9/1971 | Belgium | 164/252 |

*Primary Examiner*—Robert D. Baldwin
*Assistant Examiner*—K. Y. Lin
*Attorney, Agent, or Firm*—Fleit & Jacobson

[57] ABSTRACT

A mould wall has one or a plurality of cylindrical or tapered inserts positioned therein. The outer lateral surfaces of the inserts are provided with longitudinal through grooves bounded by the wall of the opening wherein the insert is positioned, the groove and the wall forming passages for feeding gas into the slag pool zone in the mould.

The insert may consist of a plurality of parts coaxial within one another, the outer lateral surfaces of the parts having longitudinal through grooves similar to those on the insert outer surface.

The mould construction according to the invention simplifies the technique for manufacturing ducts for feeding gas into the slag pool zone and raises the intensity of interaction between the gas and the liquid pool by feeding gas in the form of small bubbles having large total surface area.

4 Claims, 5 Drawing Figures

ELECTROSLAG REMELTING MOULD

FIELD OF THE INVENTION

The invention relates to the art of electrometallurgy, and more specifically, to electroslag remelting moulds.

DESCRIPTION OF THE PRIOR ART

Electroslag remelting of metal results in the removal therefrom of harmful impurities. However, the removal of gaseous impurities, such as oxygen, hydrogen and nitrogen, is slow and a means to remedy said disadvantage is blowing of neutral gases through the liquid metal and the slag, this being a standard metallurgical practice. In this case, the gases dissolved in the metal diffuse towards the bubbles of the gas being blown and are removed therewith. The intensity of metal degassing grows with the increase in the number and decrease in the size of the bubbles of the gas being blown. This condition is easily met by blowing gases into a ladle or furnace through bottom plugs made of refractory materials having pores less than 0.3 mm in diameter. However, such materials cannot be used in electroslag melting moulds because of the highly corrosive fluoride slags utilized in the electroslag processes. That is why openings for feeding gases into the mould cavity are usually formed by drilling or by electroerosion machining. Besides being very labourconsuming, especially when machining copper, such technique fails to provide openings less than 0.3 mm in diameter.

Known in the art is an electroslag melting mould the wall of which forms a cavity for metal and slag pools and for a solidifying ingot. The mould has through ducts formed by the openings made in the wall and intended for feeding gas into the slag pool zone (as disclosed in the Belgian Patent No. 764,521).

The degassing process in the mould of such construction is not sufficiently intensive, as the gas being forced through openings of a relatively large diameter tends to form large bubbles having a relatively small total surface area.

Moreover, said construction fails to accommodate a large number of openings in the slag pool zone of the mould.

Another disadvantage of the aforesaid construction is that its manufacture is labour-consuming due to the necessity of drilling very small openings.

The present invention has for its object the provision of an electroslag remelting mould easy to manufacture and permitting efficient degassing of metal.

Another object of the invention is to provide an electroslag remelting mould wherein liquid slag is blown with gas entering the slag pool zone in the form of a multitude of small bubbles.

Still another object of the present invention is the provision of an electroslag remelting mould the construction of which makes it possible to produce therein by simple means, ducts of a minimum cross-section sufficient for gas to pass therethrough.

Yet another object of the invention is to provide an electroslag remelting mould the construction of which allows the optimum number of gas feeding openings to be disposed in the zone of the slag pool.

A further object of the invention is the provision of an electroslag remelting mould the construction of which decreases the probability of coalescence of the gas bubbles entering the slag pool zone.

An additional object of the invention is the provision of an electroslag remelting mould the construction of which permits an easy replacement of wall inserts.

The above and other objects are attained by the provision of an electroslag remelting mould the walls of which define a cavity containing slag and metal pools and a solidifying ingot. The mould is formed with through passages for feeding gas into the slag pool zone, according to the invention, said wall is provided with at least one insert positioned in an opening communicating with said cavity, said through ducts being formed in the area of contact of the insert surface with the enveloping surface of the opening by longitudinal through grooves provided on at least one of said contacting surfaces and bounded by the other.

Said grooves may be made by cutting or knurling, i.e. by operations which are much simpler than drilling or electroerosion machining of very small openings. This makes the manufacturing of the mould much easier. The minimum cross-section of ducts is then practically independent of the technique used for forming thereof and is determined only by the throughput capacity of said ducts. This contributes to a considerable reduction in the size of gas bubbles and for an equal blowing rate, provides an increased blowing efficiency.

When necessary, the rate of blowing can be increased and the efficiency of blowing can be further increased by forming additional ducts for feeding gas into the slag pool zone. For this purpose it is advisable that the insert be composed of separate parts concentrically positioned within each another, at least one of the contacting surfaces of every pair thereof being formed with longitudinal through grooves bounded by the other surface of the same pair.

It is advisable that the depth and the width of every groove be within the range from 0.005 to 0.05 mm and the shortest distance between their like edges be no less than five times their width.

When the groove cross-section is smaller than the above specified size, the grooves are more liable to choking, and a much higher working gas pressure is necessary. When the specified size of the grooves is exceeded and the distance therebetween is decreased, relatively large bubbles are formed, this reducing the efficiency of blowing.

To facilitate the mounting and replacement of inserts and their component parts, it is advisable that their contacting surfaces be conical and taper towards the mould cavity.

It has been experimentally established that the optimum conicity of these surfaces lies within 1/100 to 1/10. When the conicity is less than the above value the insert may be plugged, and when it is greater, the gas bubbles may grow larger due to the jets converging.

BRIEF DESCRIPTION OF THE DRAWINGS

Hereinafter the invention is explained by the description of embodiments thereof taken in conjunction with the accompanying drawings, wherein.

Figure 1:
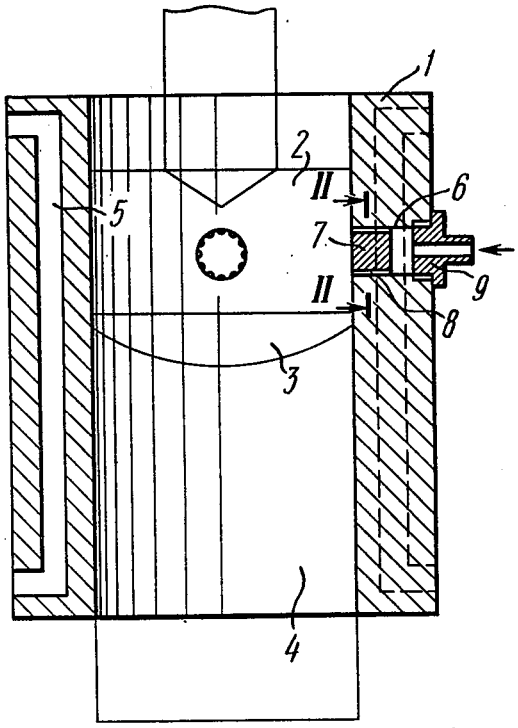
FIG. 1 is an electroslag remelting mould, according to a first embodiment of the invention, general view.
Figure 2:
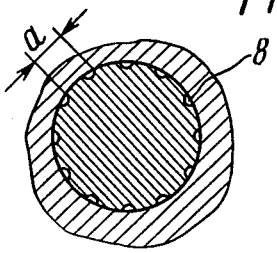
FIG. 2 is a cross section of a mould of FIG. 1 at II—II.

The electroslag remelting mould comprises a wall 1 of a closed cross-section (FIG. 1) forming a cavity for slag and metal pools and a solidifying ingot. On the drawing, their zones of location are defined by reference numerals 2, 3, 4, respectively.

The wall 1 is formed with longitudinal ducts 5 for coolant circulation. Therebetween on the level of the slag pool zone 2 there are provided one or several openings 6 with, an insert 7 being positioned in each of them according to the invention. The outer surface of the insert 7 contacting the wall of the opening 6 is provided with longitudinal through grooves 8 of semicircular or any other geometrical form. Each groove 8 being bounded by the wall of the opening 6 forms a through duct for feeding gas into the slag pool zone 2.

It should be noted that the opening 6 with the insert 7 may be located on the boundary between the zones 2 and 3 so that some of gas feeding ducts will communicate with the metal pool zone and the gas entering therethrough will act directly on liquid metal. The size of every groove 8 is chosen to provide a maximum efficiency of liquid slag processing by the gas, this being achieved by feeding a gas into the slag pool zone in the form of small non-coalescing bubbles. This condition can be met if the width and the depth of every groove 8 is 0.05 to 0.5 mm, the distance "a" between the like edges of every pair of neighboring grooves 8 being no less than five times the width of groove 8. If the grooves are less than the specified size, they are more liable to choking. Blowing a gas through ducts of such a small cross-section requires an increased working pressure. Blowing gas through grooves 8 having the width and the depth in excess of 0.5 mm, increases the probability of formation of large bubbles, the total surface area of which is inadequate for efficient removal of gaseous impurities from the slag. Large bubbles are also formed when the distance "a" is less than the five-fold width of the groove 8 because of the coalescence of several small bubbles entering the mould cavity close to one another.

The grooves 8 may be made by cutting or knurling, which simplifies machining and reduces the cross-section of the gas feeding ducts as compared to similar ducts in conventional apparatus wherein such ducts are made by drilling or electroerosion machining.

A mould according to the invention may be alternatively manufactured with grooves 8 formed in the wall of the opening 6 and a smooth surface of the insert 7, though it is evident that the preferred embodiment thereof is more amenable to manufacture.

FIG. 1 shows the cylindrical opening 6 and the cylindrical insert 7, respectively. The wall surface of the opening 6 and the surface of the insert 7 contacting said wall surface may also be conical tapering towards the mould cavity. Such design facilitates the removal of the insert 7 from the opening 6 when ever necessary. The conicity of the surfaces is chosen within the range from 1/100 to 1/10 to prevent the insert 7 from plugging, on the one hand, and avoid coalescence of separate bubbles as a result of the gas jets converging.

An inlet connection 9 communicating with gas supply system (not shown) is threaded into the opening 6 to supply a gas thereto.

Figure 3:
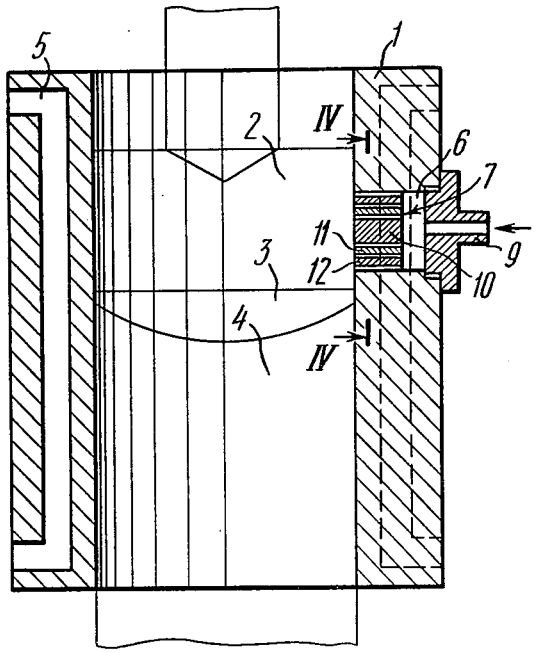
FIG. 3 is a mould provided with a composite insert, according to a second embodiment of the invention, general view.
Figure 4:
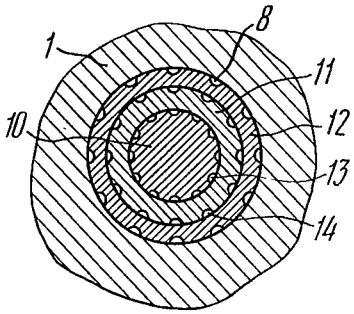
FIG. 4 is a cross section of a mould of FIG. 3 at IV—IV.
Figure 5:
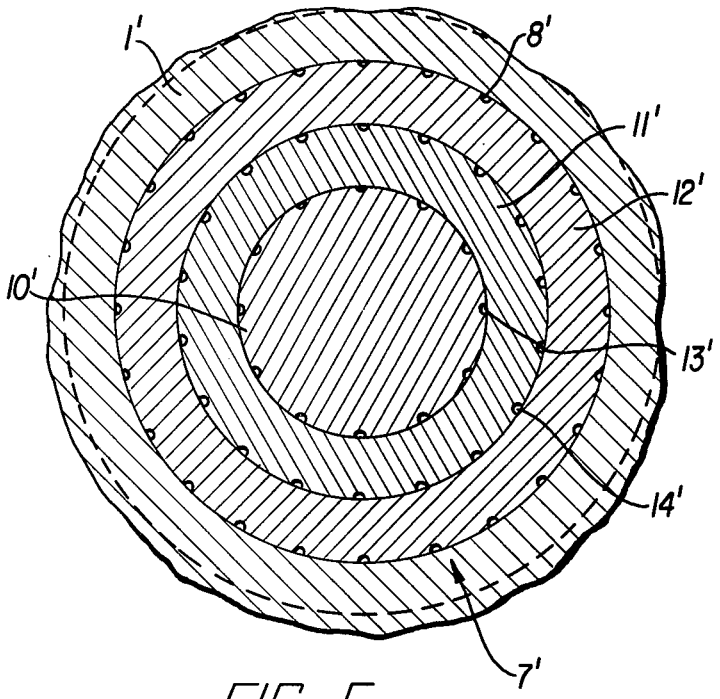
FIG. 5 is a view similar to FIG. 4 of a third embodiment of the invention.

FIGS. 3, 4, and 5 show an embodiments of the mould, according to the invention, wherein composite inserts 7 and 7', respectively, are built of concentrical parts in the form of a pin 10 and two concentric sleeves 11 and 12.

As in the above preferred embodiment, the insert 7 has on its external surface, which in the case in hand is that of the surface of the sleeve 12, longitudinal through grooves 8 forming an external annular row of gas feeding ducts. In addition, the insert 7 has two more rows of additional gas feeding ducts formed by grooves 13 made on the outer surface of the pin 10 and by grooves 14 disposed on the outer surface of the sleeve 11. As to the size, location of grooves and geometrical form of the contacting surfaces thereof, they are the same as those of the insert 7 and the opening 6 in the wall 1 of the mould shown in FIG. 1.

The number of sleeves in the insert 7 may be greater or smaller than that shown in FIGS. 3 and 4, but at least one of the contacting surfaces of each pair of all the parts incorporated in the insert 7 may carry longitudinal through grooves of the foregoing type. For these reasons it is preferable to locate the grooves on the enveloped surface.

Additional ducts in the mould increase the amount of gas fed into the slag pool zone per unit time and improve the efficiency of processing of the liquid slag, by a gas.

It should be noted that the size of the concentric parts comprising the insert 7' is limited by the requirement that minimum distance between the like edges of adjacent grooves should be no less than five times the width of the groove. This requirement should be applied to the distance between grooves in both tangential (a), as mentioned above, and radial directions.

The mould operates as follows.

Once the slag pool is formed and the power energized, a gas, e.g. argon or an argon-oxygen mixture, supply system is switched on. Gas enters the mould cavity in the form of small bubbles through the inlet connection 9 (FIG. 1) and through ducts formed by the grooves 8 of the insert 7 and the wall of the opening 6. Gases dissolved in the metal diffuse towards the surface of these bubbles, where their partial pressure is practically equal to zero, and are removed therewith. It is obvious that the greater the total surface area of the bubbles, the more efficient is the refining action of the blown gas. From this view-point, it is then preferable that the bubble size be as small as possible, and the amount of bubbles be the greatest possible.

In the preferred embodiment of the invention, shown in FIGS. 3 and 4, a gas enters the mould cavity through ducts formed by the grooves 8, 13 and 14 together with the adjoining surfaces of the contacting parts. The number of such ducts, with the same area of the wall 1 wherein the insert 7 is located, is larger than in the foregoing embodiment of the mould.

The use of the above mould for electroslag remelting of structural steel ingots 500×1500 mm in cross-section with argon-oxygen blowing through the slag pool at a rate of 5 $m^3$ per ton of metal, resulted in a metal containing not more than 0.00015% hydrogen.

The basic idea of the mould construction according to the invention may be utilized for manufacturing blast tuyeres usable either separately or as part of the mould.

What is claimed is:

1. An electroslag melting mould comprising a wall defining a cavity having zones for containing slag and metal pools and a solidifying ingot, said wall being formed with at least one opening communicating with the cavity in the zone of the slag pool; and an insert positioned within the opening in said wall so that said wall and said insert have contacting surfaces, at least one of said contacting surfaces being provided with longitudinal through grooves bounded by the other contacting surface and forming ducts for feeding gas into the slag pool zone, said insert having at least two parts, one coaxially positioned within the other so that said parts have contacting surfaces, at least one of said contacting surfaces of said parts being provided with longitudinal grooves bounded by the other contacting surface of the same pair and, said grooves forming ducts for feeding gas into the slag pool zone.

2. A mould according to claim 1, wherein the depth and the width of every groove are between 0.05 and 0.5 mm and the shortest distance between the like edges of adjacent grooves is no less than five times the width of the grooves.

3. A mould according to claim 1, wherein said contacting surfaces of said parts are conical and taper towards the mould cavity, the conicity ranging from 1/100 to 1/10.

4. A mould according to claim 1 wherein the shortest distance between any two grooves is not less than five times the width of the grooves.

* * * * *